US008297596B2

(12) United States Patent
Su

(10) Patent No.: US 8,297,596 B2
(45) Date of Patent: Oct. 30, 2012

(54) MANUALLY OPERATED PRYING TOOL

(76) Inventor: Cheng-Wei Su, Taichung (TW)

( * ) Notice: Subject to any disclaimer, the term of this patent is extended or adjusted under 35 U.S.C. 154(b) by 404 days.

(21) Appl. No.: 12/647,438

(22) Filed: Dec. 25, 2009

(65) Prior Publication Data

US 2010/0176356 A1 Jul. 15, 2010

(30) Foreign Application Priority Data

Jan. 12, 2009 (TW) ..... 098100961

(51) Int. Cl.
*B66F 3/00* (2006.01)

(52) U.S. Cl. ..... 254/129; 254/27

(58) Field of Classification Search ..... 254/129, 254/26 R, 27; 403/97
See application file for complete search history.

(56) References Cited

U.S. PATENT DOCUMENTS

| | | | | |
|---|---|---|---|---|
| 2,921,773 | A * | 1/1960 | Hoelzer | 254/129 |
| 3,186,265 | A | 6/1965 | Anthony et al. | 81/177.9 |
| 5,277,427 | A | 1/1994 | Bryan et al. | 473/232 |
| 5,473,929 | A * | 12/1995 | Karash | 72/458 |
| 6,920,807 | B2 | 7/2005 | Bond | 81/45 |
| 7,025,331 | B2 | 4/2006 | Whelan | 254/25 |
| 7,267,033 | B1 | 9/2007 | Lai | 81/57.29 |
| 7,278,626 | B1 | 10/2007 | Chang | 254/25 |
| 7,520,199 | B2 | 4/2009 | Stawarski | 81/177.8 |
| 7,628,382 | B2 | 12/2009 | Cole | 245/25 |
| 7,682,099 | B2 * | 3/2010 | Cole | 403/97 |
| 2007/0113711 | A1 | 5/2007 | Tuan Mu | 81/63.2 |
| 2007/0158626 | A1 | 7/2007 | Chang | 254/25 |
| 2007/0169590 | A1 | 7/2007 | Cole | 81/177.8 |

OTHER PUBLICATIONS

Taiwan Utility Model No. TW M260372, Apr. 1, 2005, 11 pages.
Taiwan Invention Patent No. TW 492908, Jul. 1, 2002, 4 pages.
Taiwan Utility Model No. TW 232230, Oct. 11, 1994, 3 pages.
Chinese Utility Model No. CN201169521Y, Dec. 24, 2008, 6 pages.
German Invention Patent Publication No. DE 102006028115 A1, Dec. 27, 2007, 8 pages.
Japanese Invention Patent Publication No. JP 2003-300179 A, Oct. 21, 2003, 6 pages.
Japanese Invention Patent Publication No. JP 9-131670 A, May 20, 1997, 3 pages.

* cited by examiner

*Primary Examiner* — Basil Katcheves
(74) *Attorney, Agent, or Firm* — Alan Kamrath; Kamrath IP Lawfirm, PA

(57) ABSTRACT

A manually operated prying tool includes a prying head and a handle. The head is defined at its end with an assembling hole in which are disposed a head portion of a handle of the prying tool, a ratchet wheel, a C-shaped ring, a central shaft, a spring and a stopping piece. By pushing the central shaft, the prying tool can be switched into a fixing mode, an adjustment mode, or a rotation operation mode, which allows the user to unidirectionally rotate the tool to perform a micro-angle adjustment between the prying head and the handle of the prying tool, making it convenient to use the tool.

4 Claims, 12 Drawing Sheets

MANUALLY OPERATED PRYING TOOL

BACKGROUND OF THE INVENTION

1. Field of the Invention

The present invention relates to a rotation control device for a manually operated prying tool.

2. Description of the Prior Art

Referring to FIGS. 1 and 2, a prying tool with an angle-adjustable prying head is disclosed in U.S. Pat. No. 7,278,626 and defined with a toothed cavity 11 in the assembling hole of its head 10. Disposed in the toothed cavity 11 are a rotary toothed block 12 and a spring 13. A prying handle 14 is defined in its head portion with a hexagonal hole 15 for engaging with the rotary toothed block 12. An operation button 16 is locked in one end of the assembling hole of the rotary toothed block 12, and the other end of the assembling hole is sealed with a cover 17.

In normal condition, the rotary toothed block 12 is pushed by the spring 13 to engage with the toothed cavity 11, so the head 10 and the prying handle 14 are fixed relative to each other, and so the angle therebetween is fixed and not adjustable. When the rotary toothed block 12 is disengaged from the toothed cavity 11 by pressing the operation button 16, the head 10 can be rotated bidirectionally. Thus the angle between the head 10 and the prying handle 14 is adjustable.

When the abovementioned conventional prying tool is in use, its prying handle can be fixed or rotated with respect to the head. However, in actual practice, there is a requirement for micro angle adjustment (such as 5 degrees) between the head and the prying handle. With the conventional structure, the user has to press the operation button and then carry out adjustment appropriately. Hence, not only is it impossible for the user to handle the tool with one hand, but the user to perform such micro-angle adjustment is required to be experienced and skilled.

The present invention has arisen to mitigate and/or obviate the afore-described disadvantages.

SUMMARY OF THE INVENTION

The primary object of the present invention is to provide a manually operated prying tool which comprises a prying head and a handle. The head is defined at its end with an assembling hole in which are disposed a head portion of a handle of the prying tool, a ratchet wheel, a C-shaped ring, a central shaft, a spring and a stopping piece. By pushing the central shaft, the prying tool can be switched into a fixing mode, an adjustment mode, or a rotation operation mode, which allows the user to unidirectionally rotate the tool to perform a micro-angle adjustment between the prying head and the handle of the prying tool, making it convenient to use the tool.

Hence, a manually operated prying tool is provided in accordance with the above object of the present invention and comprises a prying head and a handle. The head is defined at its end with an assembling hole in which are disposed a head portion of a handle of the prying tool, a ratchet wheel, a C-shaped ring, a central shaft, a spring and a stopping piece. The prying head is provided with a prying end at one end thereof and an assembling hole at another other end thereof. An upper assembling piece and a lower assembling piece are formed at both ends of the assembling hole. In the upper assembling piece is defined an assembling aperture. The lower assembling piece is defined with a two-step toothed groove and a through hole. The two-step toothed groove is defined with a plurality of annularly arranged bevel blocks. On a top of each of the bevel blocks is formed a bevel surface, and at a lower end of each of the bevel blocks is formed a protruding tooth. In an inner surface of the through hole is defined an annular engaging edge. The handle includes a gripping portion at one end and a head portion at the other end thereof. The head portion is formed with a ratchet hole. The head portion is disposed in the assembling hole of the prying head, and the ratchet hole is aligned and in communication with the assembling hole and the through hole. The ratchet wheel is provided with outer teeth, a central hole, and a stop flange at a lower end of an inner surface of the central hole. The ratchet wheel is inserted through the assembling aperture into the assembling hole of the prying head, and the outer teeth of the ratchet wheel are engaged with the ratchet hole of the handle and the two-step toothed groove of the prying head. The central shaft is formed with an outer annular shoulder portion, an annular protruding flange and an annular groove. The central shaft is inserted into the prying head via the assembling aperture and simultaneously into the assembling hole, the central hole of the ratchet wheel, the two-step toothed groove and the through hole. The C-shaped ring is a flexible annular structure engaged in the annular groove of the central shaft and partially protruded out of the annular groove when engaged therein. The spring is inserted through the assembling aperture onto the central shaft and has one end contacting the stop flange of the ratchet wheel. The stop piece is formed with an engaging hole and disposed in the assembling aperture. The stop piece is inserted on the central shaft via its engaging hole in such a manner that an inner end surface of the stop piece is in contact with one end of the spring, the shoulder portion of the central shaft and one end of the ratchet wheel, to prevent the spring, the central shaft and the ratchet wheel from disengaging from the prying head.

DETAILED DESCRIPTION OF THE PREFERRED EMBODIMENTS

Figure 1:
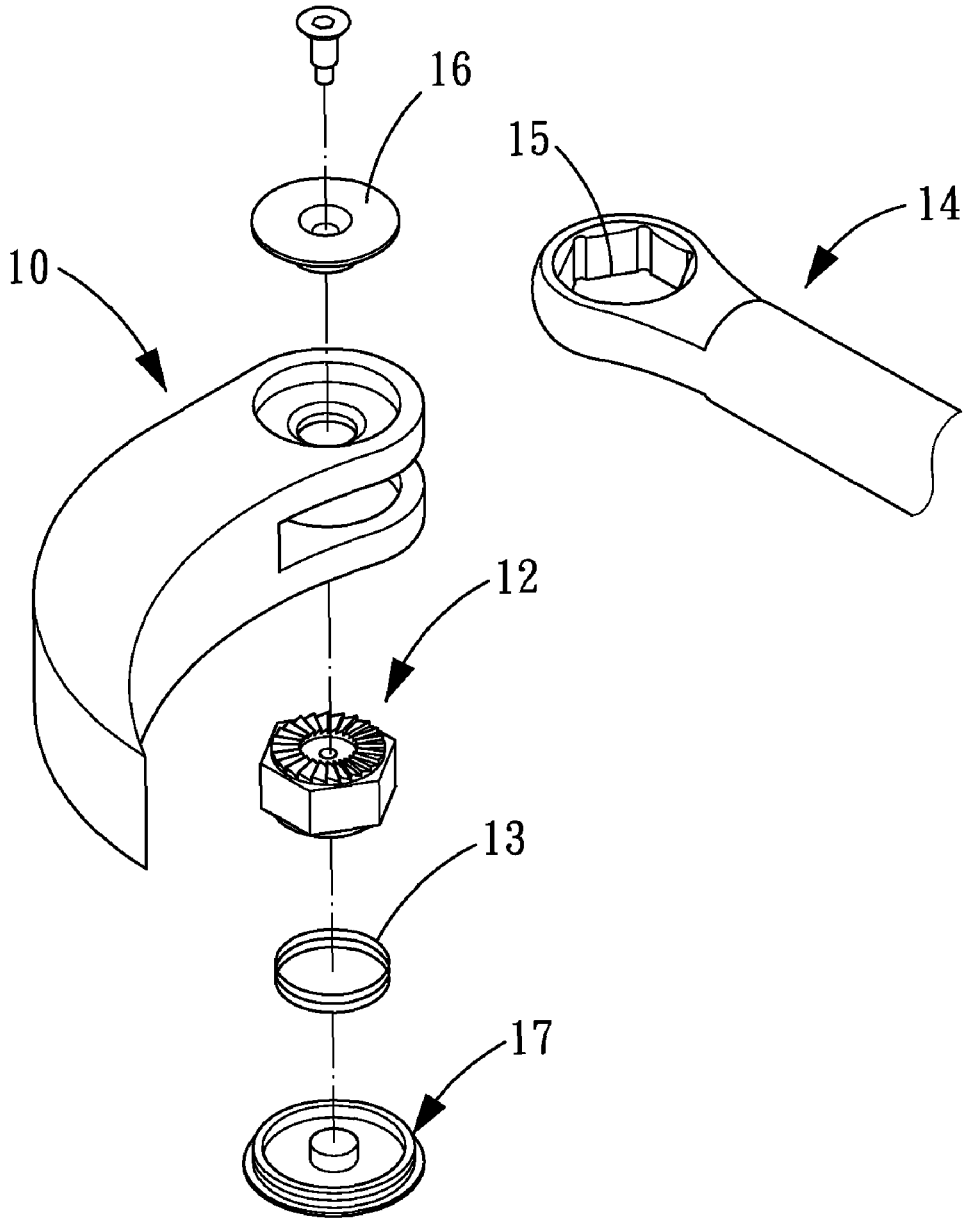
FIG. 1 PRIOR ART
FIG. 1 is an exploded view of a prying tool disclosed in U.S. Pat. No. 7,278,626.
Figure 2:
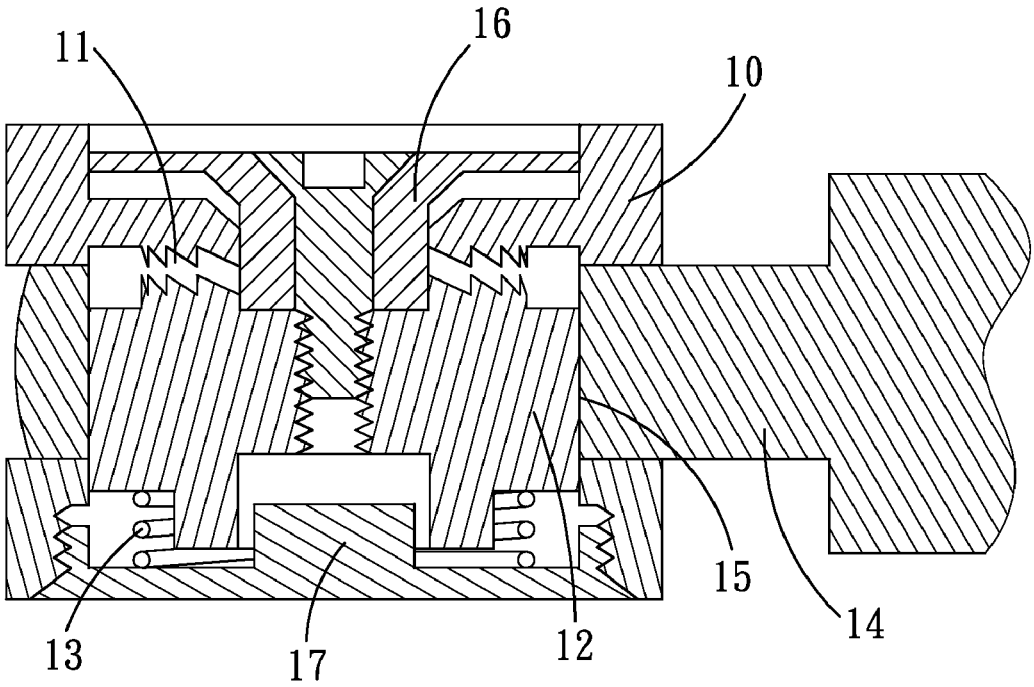
FIG. 2 PRIOR ART
FIG. 2 is a cross sectional view of the prying tool disclosed in U.S. Pat. No. 7,278,626.
Figure 3:
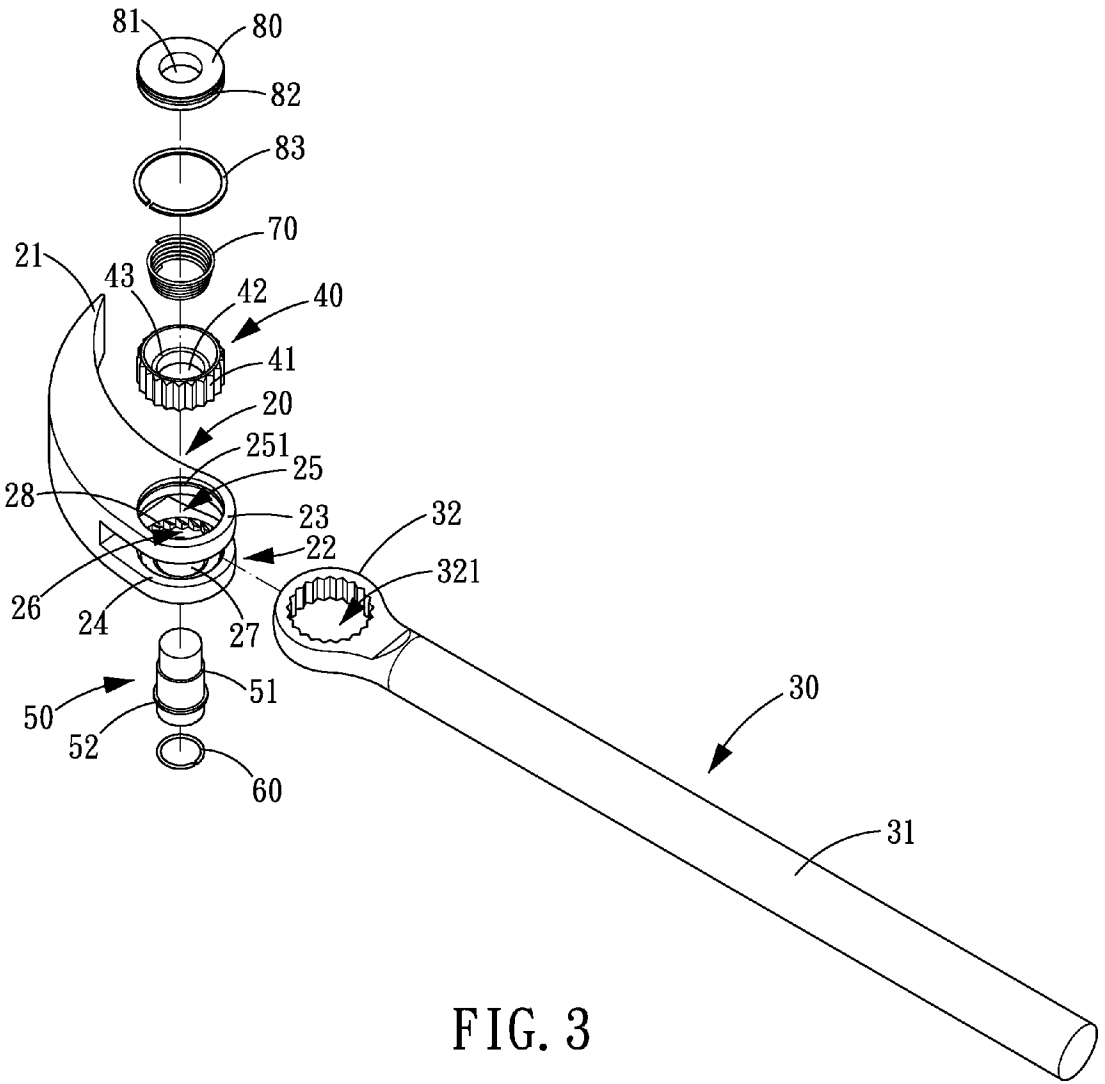
FIG. 3 is an exploded view of a prying tool in accordance with the present invention.
Figure 4:
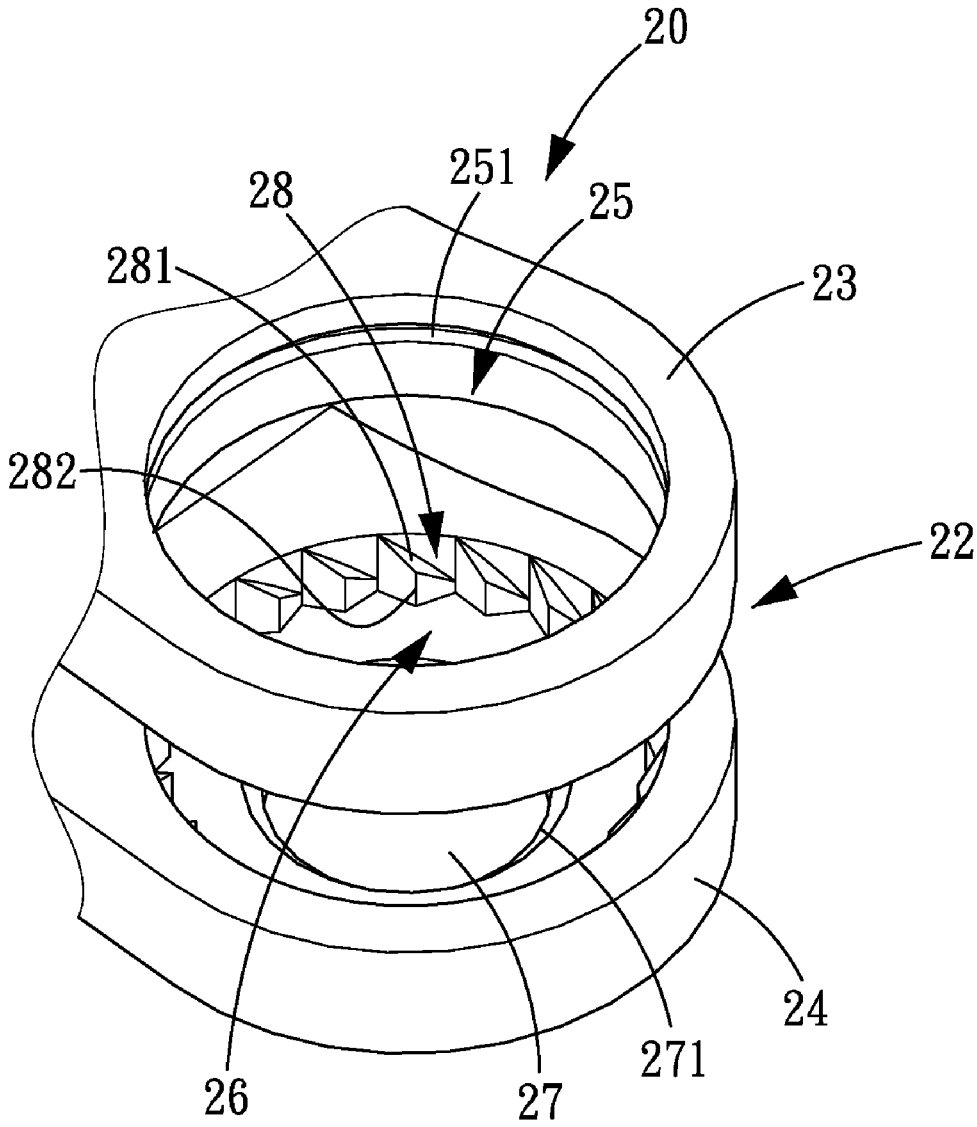
FIG. 4 is an amplified view of the prying tool in accordance with the present invention.
Figure 5:
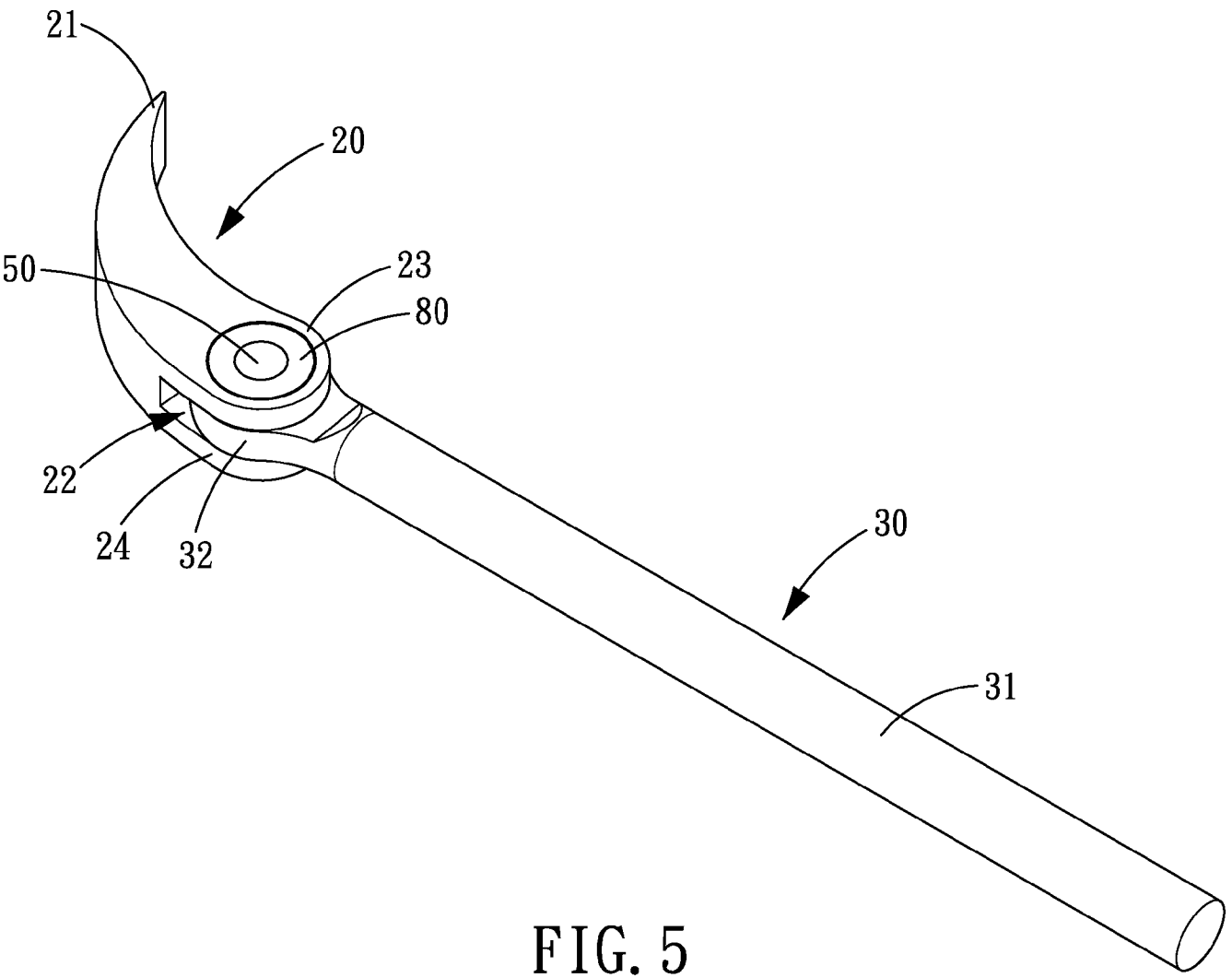
FIG. 5 is an assembly view of the prying tool in accordance with the present invention.

The present invention will be clearer from the following description when viewed together with the accompanying drawings, which show, for purpose of illustration only, the preferred embodiments in accordance with the present invention.

Referring to FIGS. 3-6, a manually operated prying tool in accordance with the present invention comprises a prying head 20 and a handle 30. The prying head 20 is defined at its end with an assembling hole 22 in which are disposed a head portion 32 of a handle 30 of the prying tool, a ratchet wheel 40, a C-shaped ring 60, a central shaft 50, a spring 70 and a stop piece 80.

The prying head 20 is provided with a prying end 21 at one end thereof, and the assembling hole 22 is formed at the other end of the prying head 20. Formed at both ends of the assembling hole 22 are an upper assembling piece 23 and a lower assembling piece 24. In the upper assembling piece 23 is defined an assembling aperture 25, and in the inner wall of the assembling aperture 25 is formed an annular engaging groove 251. The lower assembling piece 24 is defined with a two-step toothed groove 26 and a through hole 27. The two-step toothed groove 26 is defined with a plurality of annularly arranged bevel blocks 28. On the top of each of the bevel blocks 28 is formed a bevel surface 281, and at the lower end of each of the bevel blocks 28 is formed a protruding tooth 282. In the inner surface of the through hole 27 is defined an annular engaging edge 271.

The handle 30 includes a gripping portion 31 at one end thereof and a head portion 32 at the other. The head portion 32 is formed with a ratchet hole 321. The head portion 32 is disposed in the assembling hole 22 of the prying head 20, and the ratchet hole 321 is aligned and in communication with the assembling aperture 25 and the through hole 27.

The ratchet wheel 40 is provided with outer teeth 41, a central hole 42, and a stop flange 43 at a lower end of the inner surface of the central hole 42. The ratchet wheel 40 is inserted through the assembling aperture 25 into the assembling hole 22 of the prying head 20, and the outer teeth 41 of the ratchet wheel 40 are engaged with the ratchet hole 321 of the handle 30 and the two-step toothed groove 26 of the prying head 20.

The central shaft 50 is formed with an outer annular shoulder portion 51, an annular protruding flange 52 and an annular groove 53. The central shaft 50 is inserted into the prying head 20 via the assembling aperture 25 and simultaneously into the assembling hole 22, the central hole 42 of the ratchet wheel 40, the two-step toothed groove 26 and the through hole 27.

The C-shaped ring 60 is a flexible annular structure engaged in the annular groove 53 of the central shaft 50 and partially protrudes out of the annular groove 53 when it is engaged therein.

The spring 70 is inserted through the assembling aperture 25 onto the central shaft 50 and has one end contacting the stop flange 43 of the ratchet wheel 40.

The stop piece 80 is formed with an engaging hole 81, and around the outer periphery of the stop piece 80 is formed an annular retaining groove 82. The stop piece 80 is disposed in the assembling aperture 25 and retained therein by a C-shaped retainer 83 disposed in the annular retaining groove 82 and the annular engaging groove 251. The stop piece 80 is inserted on the central shaft 50 via its engaging hole 81 in such a manner that the inner end surface of the stop piece 80 is in contact with the end of the spring 70, the shoulder portion 51 of the central shaft 50 and the end of the ratchet wheel 40, to prevent the spring 70, the central shaft 50 and the ratchet wheel 40 from disengaging from the prying head 20.

For a better understanding of the embodiment of the present invention, its operation and effect, reference should be made to FIGS. 3-6 again. In assembly of the prying tool, the head portion 32 of the handle 30 is inserted in the assembling hole 22 of the prying head 20, making the ratchet hole 321 aligned and in communication with the assembling aperture 25 and the through hole 27. Then, the ratchet wheel 40 is inserted in the assembling hole 22 through the assembling aperture 25 of the prying head 20 in such a manner that the outer teeth 41 of the ratchet wheel 40 are engaged with the ratchet hole 321 of the handle 30 and the two-step toothed groove 26 of the prying head 20. After that, the central shaft 50 is inserted through the assembling aperture 25 into the prying head 20 and simultaneously into the assembling aperture 25, the central hole 42 of the ratchet wheel 40, the two-step toothed groove 26 and the through hole 27. Then, the C-shaped ring 60 and the spring 70 are inserted onto the central shaft 50. Finally, the assembly of the prying tool can be finished by sealing the assembling aperture 25 with the stop piece 80.

The prying tool of the present invention provides three operation modes, namely, the prying head and the hand of the prying tool can be fixed (fixing mode) or can rotate (rotation mode) with respect to each other, and the angle between the prying head and the handle of the prying tool can be adjusted (adjustment mode).

Figure 6:
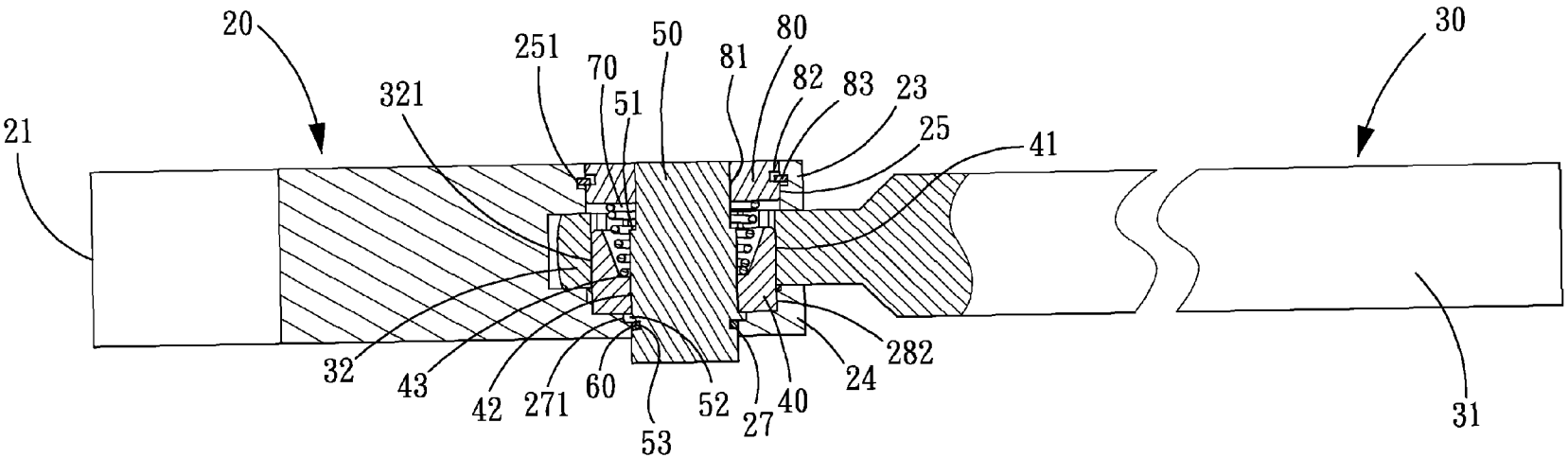
FIG. 6 is a cross sectional view showing the prying tool in accordance with the present invention set in a fixing mode.
Figure 7:
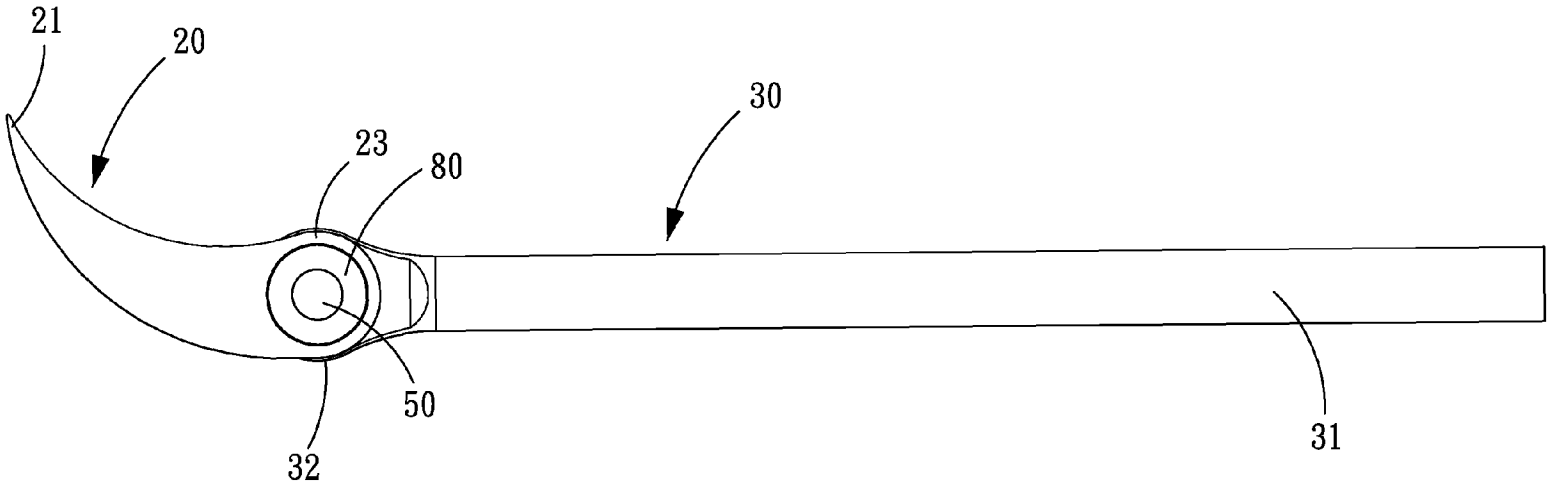
FIG. 7 is a side view showing the prying tool in accordance with the present invention set in a fixing mode.

Referring to FIGS. 6 and 7, to switch the prying tool to the fixing mode, namely, to make the prying head 20 and the handle 30 of the prying tool fixed with respect to each other, the user can push the central shaft 50 toward the through hole 27 until the annular protruding flange 52 of the central shaft 50 is engaged in the annular engaging edge 271. Then, the prying head 20 and the handle 30 of the prying tool are fixed with respect to each other, as shown in FIG. 6. When the central shaft 50 is being pushed, the spring 70 will push the ratchet wheel 40 to make the outer teeth 41 engage with the protruding teeth 282. Meanwhile, the C-shaped ring 60 will be pushed backed into the annular groove 53 and in contact with the outer surface of the through hole 27. In the fixing mode, the ratchet wheel 40 and the prying head 20 are engaged together and not allowed to rotate relative to each other, and the handle 30 is also engaged with the prying head 20. At this state, the prying tool can be used to perform prying tasks.

Figure 8:
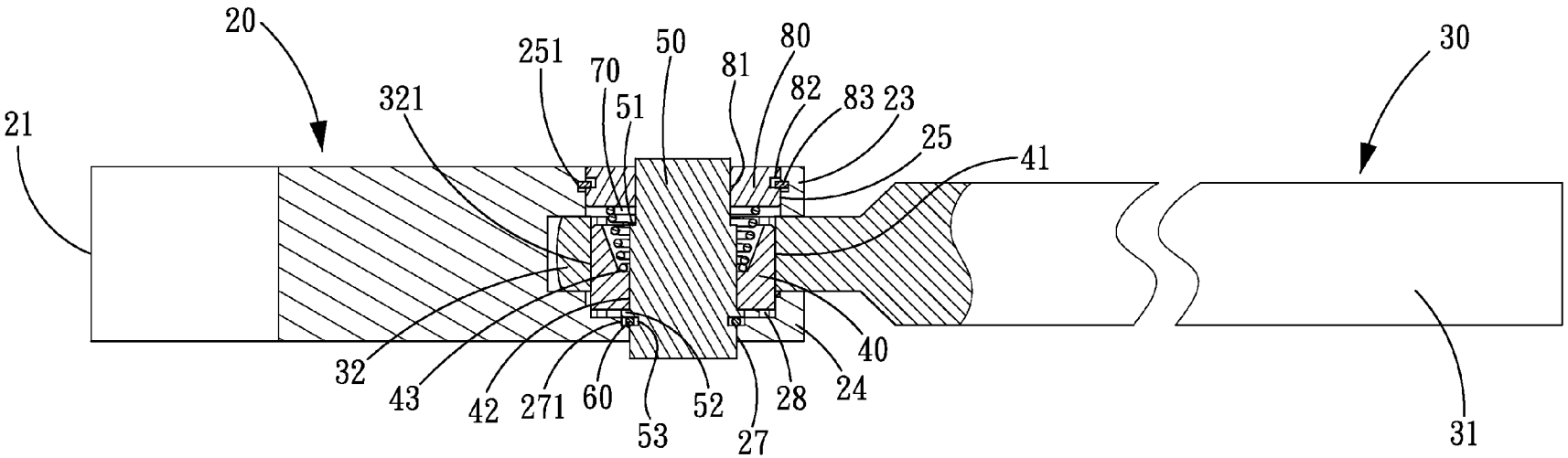
FIG. 8 is a cross sectional view showing the prying tool in accordance with the present invention set in an adjustment mode.
Figure 9:
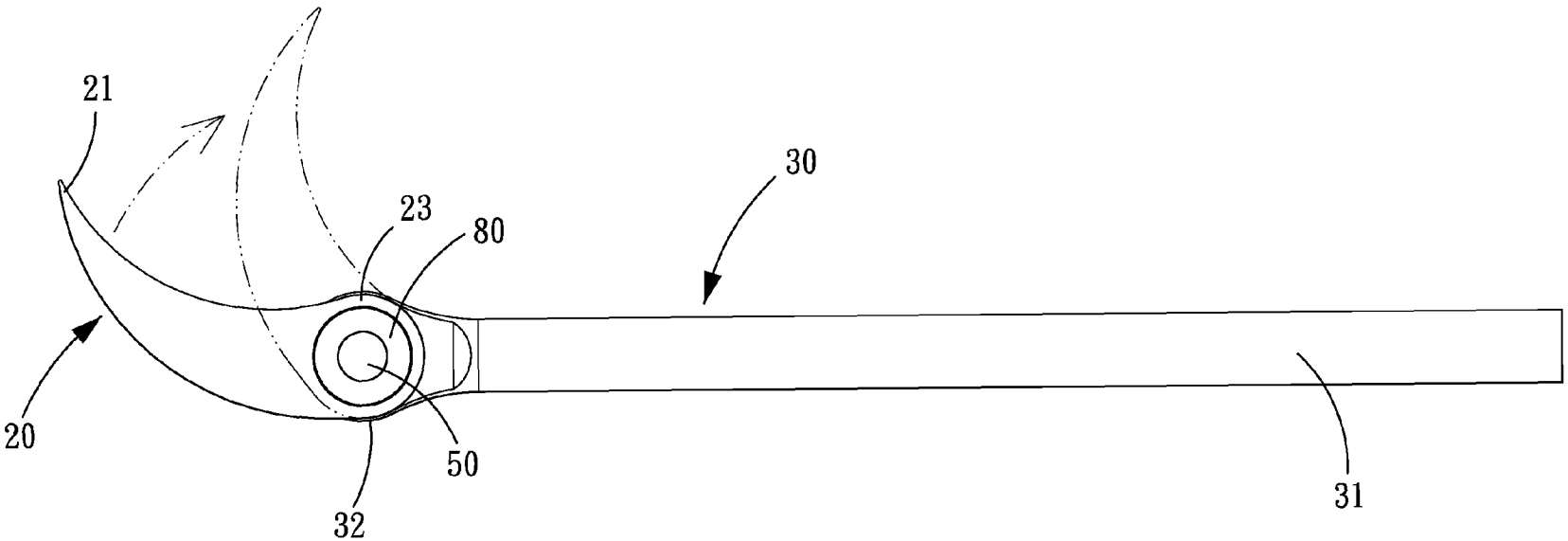
FIG. 9 is a side view showing the prying tool in accordance with the present invention set in an adjustment mode.
Figure 10:
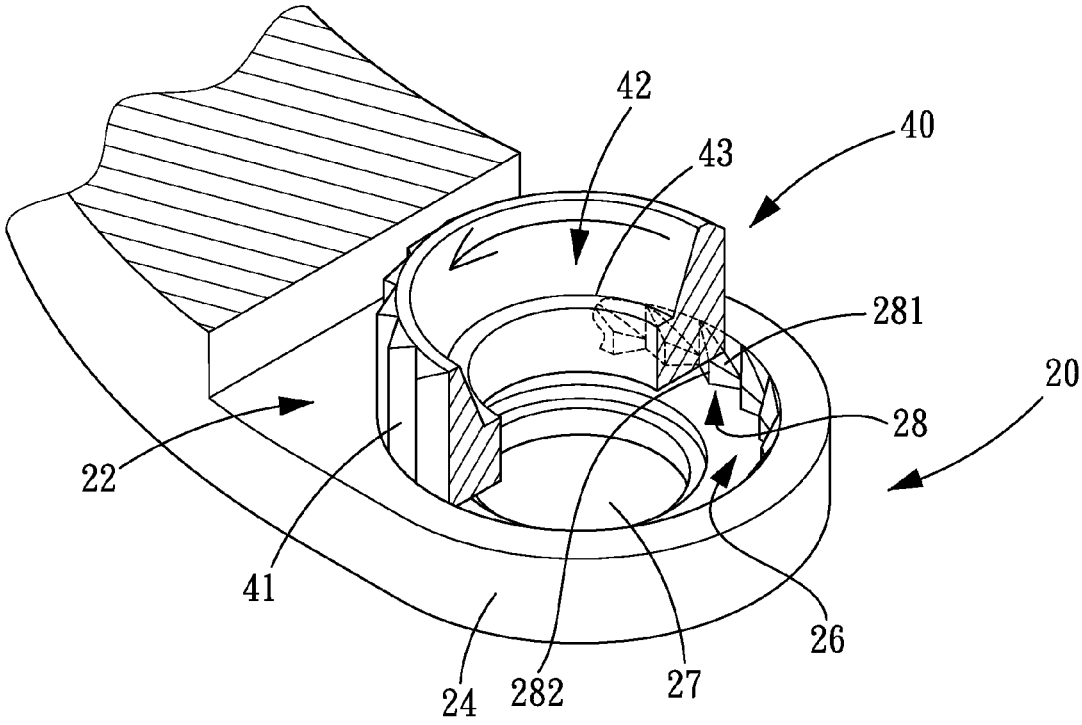
FIG. 10 is an illustrative view showing the state of the outer teeth of the ratchet wheel and the bevel surface of the bevel block of the prying head in accordance with the present invention.

Referring then to FIGS. 8 and 9, to switch the prying tool to the adjustment mode, namely, to adjust the angle between the prying head 20 and the handle 30, the user can push the central shaft 50 toward the assembling aperture 25 until the C-shaped ring 60 is engaged in the annular engaging edge 271. At this moment, the outer teeth 41 of the ratchet wheel 40 are engaged with the lower end of the bevel surface 281 of the bevel blocks 28. Thus, the ratchet wheel 40 and the prying head 20 are in partial engagement with each other, so that the user can rotate the plying head 20 unidirectionally. During rotation, (for easy description, only one outer tooth 41 is described) the outer tooth 41 of the ratchet wheel 40 moves upward toward the assembling aperture 25 from the lower end of the bevel surface 281 of one bevel block 28. When it moves to the top end of the bevel surface 281 of the bevel block 28, the travel for one-tooth-angle adjustment has been finished, and the outer tooth 41 will move back down to the lower end of the bevel surface 281 of the next bevel block 28. Thus, a one-tooth-angle adjusted is completed, and by repeating the above operation, the angle between the prying head 20 and the handle 30 is adjusted.

It is to be noted that, in normal conditions, the prying tool can preferably be set in the adjustment mode, so that the user can easily unidirectionally rotate the prying head 20 to perform a micro-angle or large-angle adjustment between the prying head 20 and the handle 30. Unlike the conventional structure, the angle adjustment of the present invention doesn't require the user to press the button with the other hand. Furthermore, the adjustment mode of the present invention allows the angle of the prying head 20 to be adjusted in an angle by angle manner. Hence, it is a more precise angle adjustment than the conventional structure.

Figure 11:
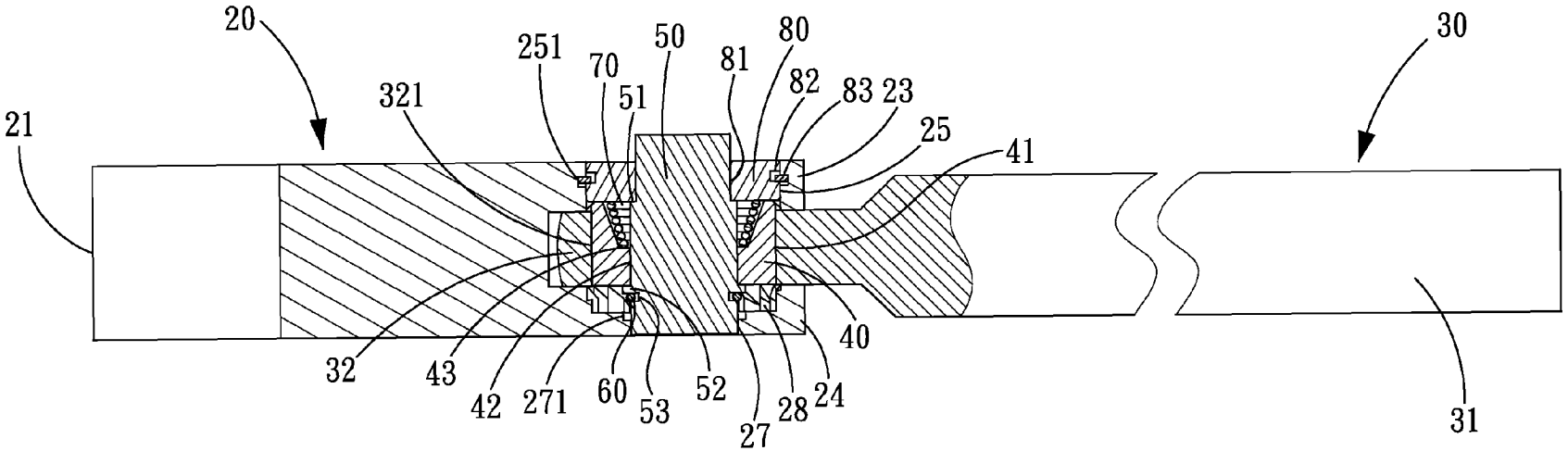
FIG. 11 is a cross sectional view showing the prying tool in accordance with the present invention set in a rotation mode.
Figure 12:
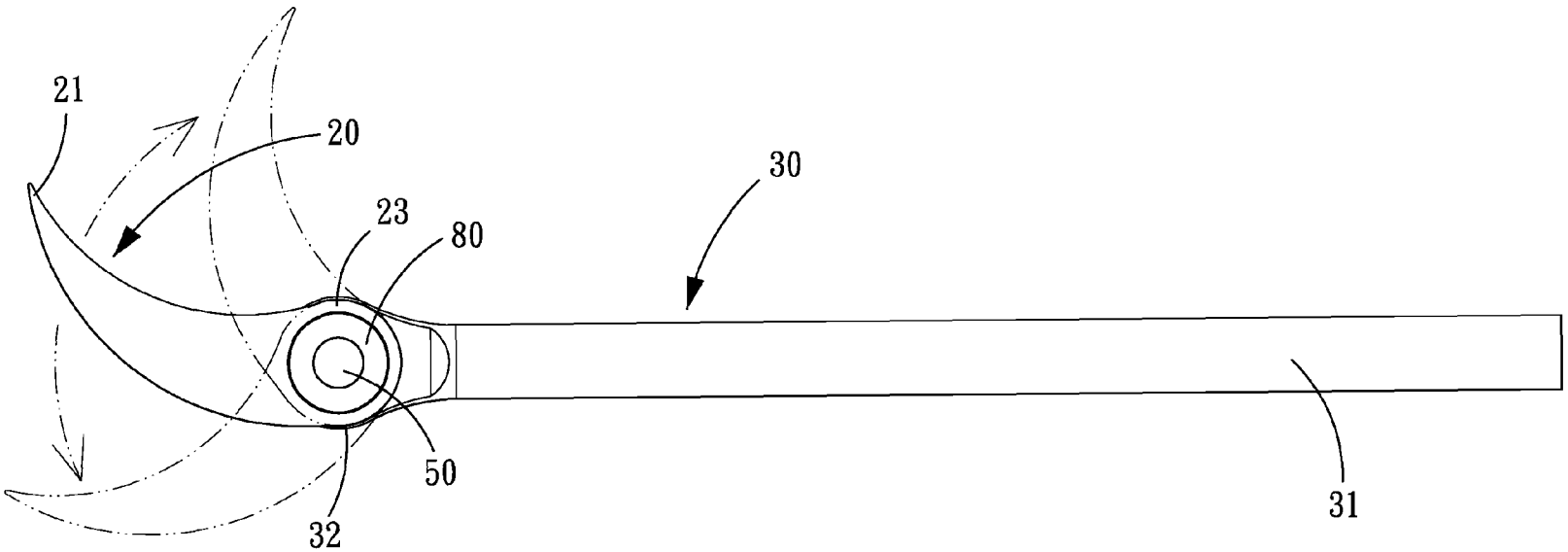
FIG. 12 is a side view showing the prying tool in accordance with the present invention set in a rotation mode.

Referring finally to FIGS. 11 and 12, to switch the prying tool into the rotation mode, the user can push the central shaft 50 toward the assembling aperture 25 until the outer annular shoulder portion 51 of the central shaft 50 abuts against the stop piece 80. Thus, the prying tool is switched into the rotation mode. At this moment, the outer teeth 41 of the ratchet wheel 40 will move out of contact with the bevel blocks 28. In this rotation mode, the ratchet wheel 40 and the prying head 20 are disengaged from each other. Thus, the user can rotate the prying head 20 bidirectionally. In other words, it allows a bidirectional angle adjustment between the prying head 20 and the handle 30.

While various embodiments in accordance with the present invention have been shown and described, it is clear to those skilled in the art that further embodiments may be made without departing from the scope of the present invention.

What is claimed is:

1. A manually operated prying tool comprising:

a prying head provided with a prying end at one end thereof and an assembling hole at another other end thereof, with an upper assembling piece and a lower assembling piece formed at both ends of the assembling hole, with an assembling aperture defined in the upper assembling piece, with the lower assembling piece including a through hole terminating in a first step having a first annular engaging edge of a diameter greater than a diameter of the through hole, with the first annular engaging edge terminating in a second step having a second annular engaging edge of a diameter greater than the diameter of the first step and the upper assembly price, with a plurality of annularly arranged bevel blocks extending from the second annular engaging edge radially inwardly on the second step, with a bevel surface formed on a top of each of the plurality of annularly arranged bevel blocks, and with a protruding tooth formed at a lower end of each of the plurality of annularly arranged bevel blocks;

a handle including a gripping portion at one end and a head portion at the other, with the head portion formed with a ratchet hole, with the head portion disposed in the assembling hole of the prying head, and with the ratchet hole aligned and in communication with the assembling hole and the through hole;

a ratchet wheel provided with first and second axial ends and outer teeth and a central hole axially extending between the first and second axial ends, with a stop flange formed at a lower end of an inner surface of the central hole, with the ratchet wheel inserted through the assembling aperture into the assembling hole of the prying head, with the outer teeth of the ratchet wheel engaged with the ratchet hole of the handle and the second annular engaging edge of the prying head and with the second axial end abutable with the second step;

a central shaft formed with an outer annular shoulder portion, an annular protruding flange and an annular groove, with the central shaft inserted into the prying head via the assembling aperture and simultaneously into the assembling hole, the central hole of the ratchet wheel, the first and second annular engaging edge and the through hole;

a C-shaped ring being a flexible annular structure engaged in the annular groove of the central shaft and partially protruded out of the annular groove when engaged therein to an extent for receipt in the first annular engaging edge;

a spring inserted through the assembling aperture onto the central shaft and having one end contacting the stop flange of the ratchet wheel; and a stop piece formed with an engaging hole and disposed in the assembling aperture, with the stop piece inserted on the central shaft via the engaging hole, wherein an inner end surface of the stop piece is in contact with the spring, the shoulder portion of the central shaft and the ratchet wheel, wherein the spring, the central shaft and the ratchet wheel are prevented from disengaging from the prying head.

2. The manually operated prying head as claimed in claim 1, wherein an annular engaging groove is formed in an inner wall of the assembling aperture of the prying head, wherein an annular retaining groove is formed around an outer periphery of the stop piece, and wherein the stop piece is disposed in the assembling aperture and retained therein by a C-shaped retainer disposed in the retaining groove of the stop piece and the engaging groove of the prying head.

3. The manually operated prying head as claimed in claim 2, wherein the central shaft switch is switchable between a fixing mode, an adjustment mode, and a rotate mode;

with the central shaft switched to the fixing mode, the outer teeth of the ratchet wheel engaged with the protruding teeth of the bevel blocks, with the ratchet wheel and the prying head engaged together and not allowed to rotate relative to each other;

with the central shaft switched to the adjustment mode, the bottom surface of the ratchet wheel engaging with and slidable with respect to the first and second sections of the bevel surface of the bevel blocks, with the ratchet wheel and the prying head allowed to rotate unidirectionally relative to each other; and with the central shaft switched to the rotate mode, the outer teeth of the ratchet wheel move out of contact with the bevel blocks.

4. The manually operated prying head as claimed in claim 1, wherein the central shaft switch is switchable between a fixing mode, an adjustment mode, and a rotate mode;

with the central shaft switched to the fixing mode, the outer teeth of the ratchet wheel engaged with the protruding teeth of the bevel blocks, with the ratchet wheel and the prying head engaged together and not allowed to rotate relative to each other;

with the central shaft switched to the adjustment mode, the bottom surface of the ratchet wheel engaging with and slidable with respect to the first and second sections of the bevel surface of the bevel blocks, with the ratchet wheel and the prying head allowed to rotate unidirectionally relative to each other; and with the central shaft switched to the rotate mode, the outer teeth of the ratchet wheel move out of contact with the bevel blocks.

* * * * *